US006439403B1

(12) United States Patent
Levsen

(10) Patent No.: US 6,439,403 B1
(45) Date of Patent: Aug. 27, 2002

(54) KNIFE HOLDER

(75) Inventor: Clark A. Levsen, Shawnee, KS (US)

(73) Assignee: Hantover, Inc., Kansas City, MO (US)

( * ) Notice: Subject to any disclaimer, the term of this patent is extended or adjusted under 35 U.S.C. 154(b) by 0 days.

(21) Appl. No.: 09/452,121

(22) Filed: Nov. 30, 1999

(51) Int. Cl.[7] ..... A47F 7/00
(52) U.S. Cl. ..... 211/70.7; 248/37.3; D7/637
(58) Field of Search ..... 211/70.7, 70.6; 248/37.3, 176.1; 206/553; D7/637

(56) References Cited

U.S. PATENT DOCUMENTS

| | | | | | |
|---|---|---|---|---|---|
| 1,346,909 | A | | 7/1920 | Onufryk | |
| 1,861,683 | A | | 6/1932 | Branch | |
| D110,294 | S | | 6/1938 | Speik | |
| 3,653,973 | A | * | 4/1972 | Broglid | 163/114 |
| 3,980,608 | A | * | 9/1976 | Faltersack | 248/37.3 |
| 4,318,478 | A | | 3/1982 | DeWinter | |
| 4,423,552 | A | | 1/1984 | Bourgein et al. | |
| 4,511,040 | A | * | 4/1985 | Tolentino | 206/553 |
| 4,561,548 | A | * | 12/1985 | Call | 211/70.7 |
| 4,575,939 | A | | 3/1986 | Buchtel | |
| 4,993,786 | A | * | 2/1991 | De Giulio | 312/298 |
| 5,454,534 | A | * | 10/1995 | Baskas | 248/37.3 |
| 5,620,622 | A | * | 4/1997 | Lang | 219/385 |
| 5,738,228 | A | | 4/1998 | Bittinger | |
| 5,947,276 | A | | 9/1999 | Hsu | |
| 6,082,559 | A | * | 7/2000 | Levsen | 211/70.7 |

* cited by examiner

*Primary Examiner*—Daniel P. Stodola
*Assistant Examiner*—Khoa Tran
(74) *Attorney, Agent, or Firm*—Hovey Williams LLP

(57) ABSTRACT

A utensil holder (10) for knives (22) or similar utensils includes an upright, open top housing (12) having a retainer (14) therein. The retainer (14) includes a set (18) of side-by-side, laterally shiftable web members (20) with utensil entrance openings (61) defined between adjacent web members (20). The web member set (18) is held within the housing (12) by a U-shaped keeper (16). When a knife or other implement is inserted into an entrance opening (61), the adjacent web members (20) are slightly laterally separated but resiliently engage the blade (64) of the knife (22).

20 Claims, 2 Drawing Sheets

KNIFE HOLDER

BACKGROUND OF THE INVENTION

1. Field of the Invention

The present invention is broadly concerned with an improved utensil holder for knives or other blade-type kitchen utensils which will accommodate a wide variety of such utensils and permits easy cleanup and sanitation. The preferred utensil holder of the invention includes a housing and a utensil retainer located therein, with the retainer having a plurality of side-by-side web members presenting a utensil-receiving opening between adjacent ones of the web members; the web members are configured to exert a compressive retaining force against utensil portions received therebetween.

2. Description of the Prior Art

A variety of utensil holders such as wooden knife blocks are commonly urged in industry and in many households. A typical knife block is traditionally provided with a number of open slots, each of which is specifically designed for receiving a certain sized and shaped utensil. That is to say, each slot is designed to receive a specific utensil, and it is therefore unlikely that the slot can receive a utensil other than that intended to correspond with the slot. This, of course, presents the problem of matching the utensil set with the utensil block. A utensil not specifically corresponding with the slots in the holder will likely have to be stored separate from the block. Another problem with conventional utensil holders involves sanitation. Particularly, the narrow slots for receiving the utensils are nearly impossible to clean. This is particularly problematic when the holder is used in industrial applications (e.g., restaurants), wherein it would be beneficial to provide a support for the utensil during use. Yet another problem with the utensil-receiving slots of conventional holders involves the difficulty of inserting the utensils into the slots. Oftentimes the slot for a knife is relatively narrow and the user may be required to handle the knife blade to help guide the blade into the slot.

SUMMARY OF THE INVENTION

The present invention overcomes the problems outlined above and provides an improved utensil holder including a housing presenting a utensil-receiving opening together with a utensil retainer located within the housing and proximal to the opening. The retainer includes a plurality of side-by-side web members each having an entrance end and a remote end; utensil-receiving openings are defined between adjacent ones of the web members for receiving therein utensil portions (e.g., knife blades). The web members are configured to exert a compressive retaining force against such utensil portions.

The utensil holder housing is preferably an upright, square or rectangular in cross-section body having a base and upstanding sidewalls. The housing may be formed of any suitable material. The web members are preferably integrally formed of a synthetic resin material and are of generally V-shaped configuration in cross-section, presenting an elongated apex and a pair of diverging web sections. The web members are placed in juxtaposition so that at least the lower ends thereof are in contact with each other, prior to insertion of a utensil into the holder. In order to retain the web members within the housing, a U-shaped keeper is provided which fits within the housing and has appropriate retaining structure (such as uppermost, inwardly extending flanges and lower supporting ledges) for keeping the web members in side-by-side alignment.

In use, a knife or other utensil is slid downwardly between adjacent web members and is retained therein by virtue of the compressive forces exerted against the knife. The holder is preferably sized to accommodate implements of varying widths and lengths, and may be readily disassembled for cleaning purposes.

DETAILED DESCRIPTION OF THE PREFERRED EMBODIMENT

Figure 1:
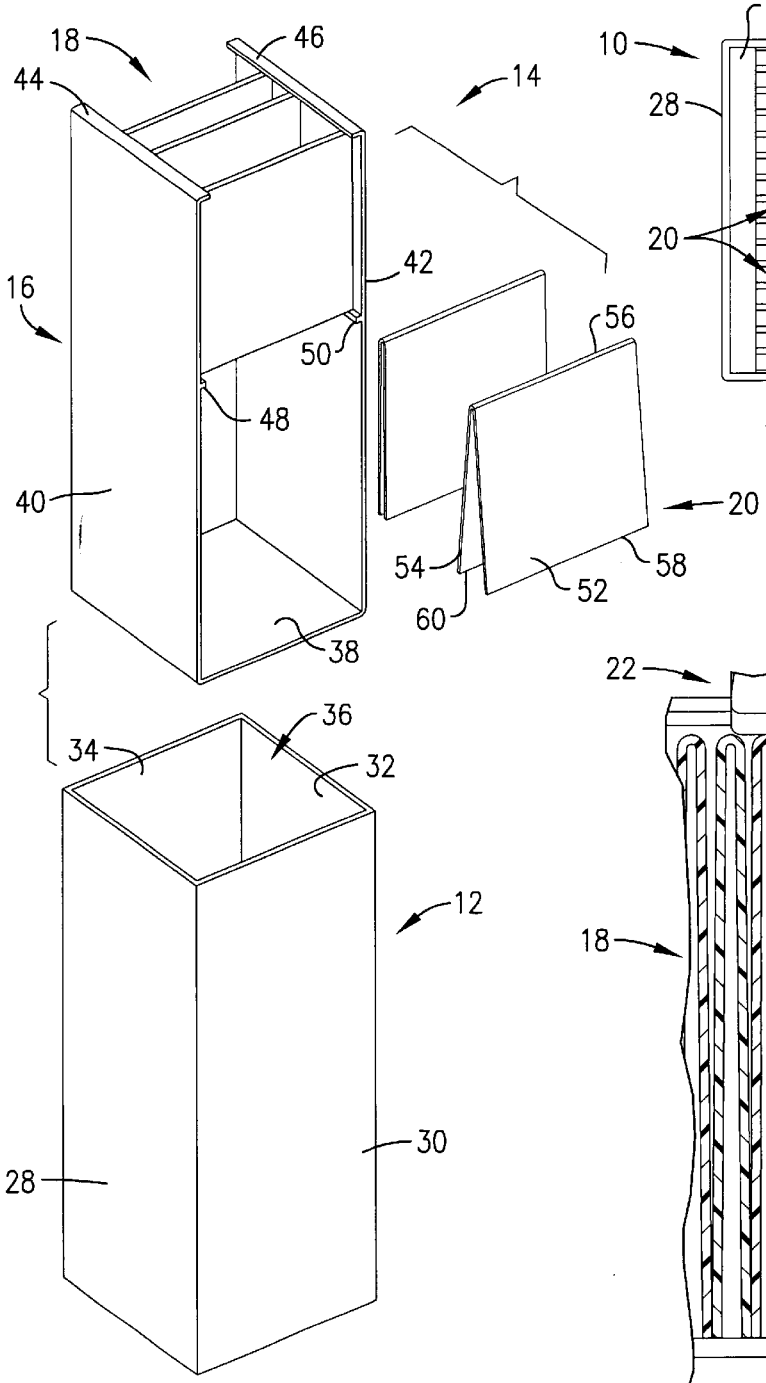
FIG. 1 is an exploded view of the preferred knife holder of the invention, illustrating the housing and utensil retainer in separated relation.
Figure 2:
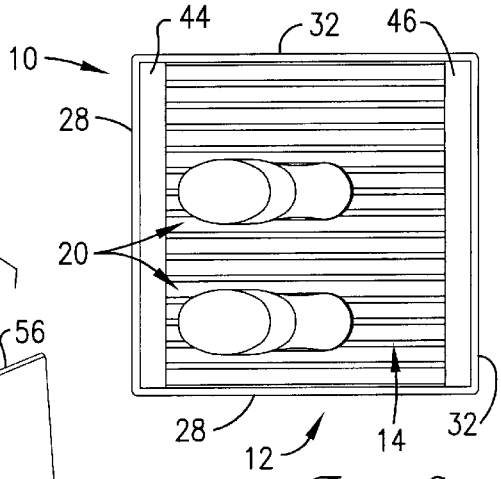
FIG. 2 is a plan view of the knife holder, illustrating two knives within the holder.

Turning now to the drawings, a utensil holder 10 is illustrated broadly including a housing 12 and a retainer 14 located within the housing. The retainer includes a keeper 16 as well as a pack or set 18 of individual web members 20. The holder 10 is designed to releasably hold one or more utensils such as knives 22.

In more detail, the housing 12 is in the form of an elongated, unitary, upright body presenting a lower base 24 equipped with corner-mounted feet 26 as well as upstanding sidewalls 28, 30, 32, 34 presenting an open upper end 36. As shown, the housing 12 is designed to stand on the feet 26, on a table, counter top or any convenient horizontal surface. The housing 12 may be formed of a variety of materials such as metal, synthetic resin or wood.

The keeper 16 is of a generally U-shaped, integral body presenting a lower panel 38 as well as upwardly extending side panels 40,42. The panels 40,42 have inwardly extending marginal lips or flanges 44, 46 adjacent the upper end thereof, as well as inwardly extending ledges 48, 50 spaced downwardly from the flanges 44, 46. The keeper 16 is preferably formed of a suitable synthetic resin material. As illustrated, the keeper 16 is designed to be received within housing 12, with bottom panel 38 abutting base 24 and with side panels 40,42 in close abutting contact with opposed sidewalls of the housing.

Figure 5:
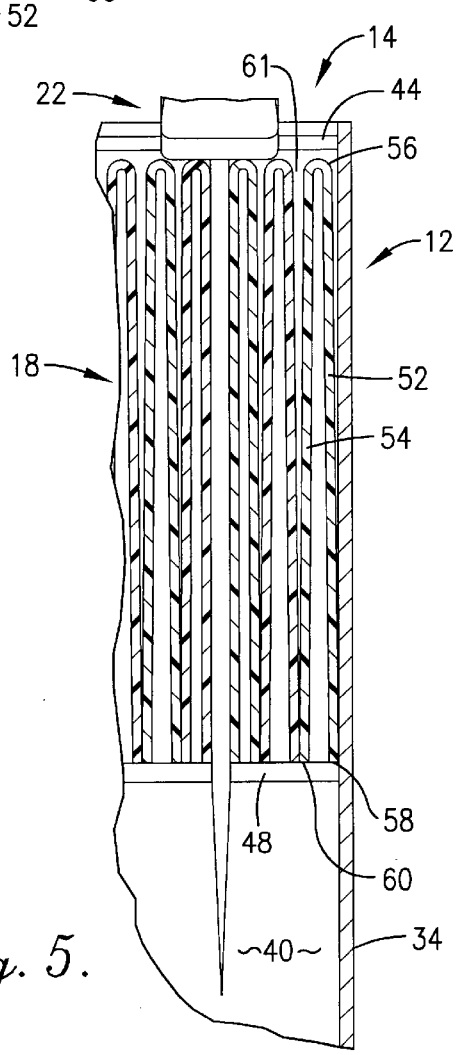
FIG. 5 is an enlarged, fragmentary view in vertical section illustrating in detail the knife holder configuration during use thereof.
Figure 3:
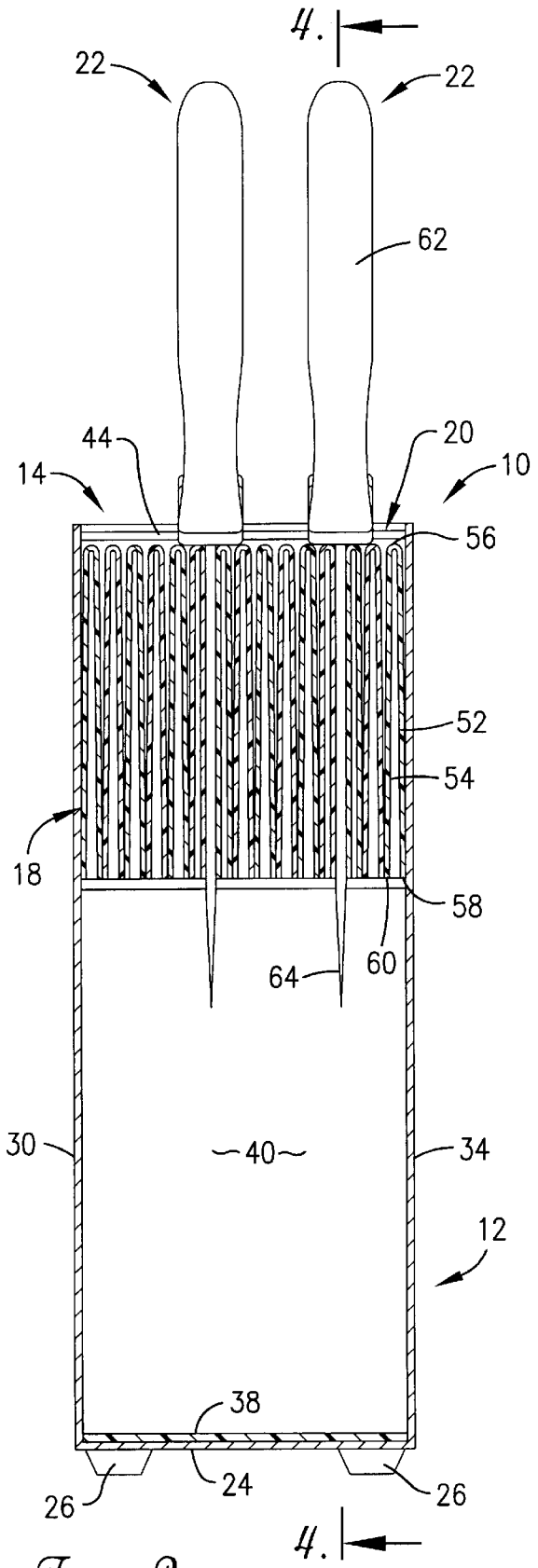
FIG. 3 is a vertical sectional view of the holder depicted in FIG. 2 and illustrating the action of the resilient utensil-retaining web members forming a part of the utensil retainer.

The web member set 18 is made of a plurality of essentially identical web members 20. Referring to FIG. 1, it will be observed that each web member 20 is preferably in the form of interconnected (e.g., integral) web sections 52, 54 so that, in cross-section, the web member presents a generally V-shape configuration with an elongated apex 56 and the web sections 52, 54 diverging therefrom to present lower or remote margins 58, 60. As best illustrated in FIGS. 3 and 5, the individual web members 20 are placed in guide-by-side relationship to form the set 20, with at least the lower portions of the proximal web sections 52, 54 in engagement with each other.

The web members 20 are retained within keeper 16 between the cooperating flanges and ledges 44, 48 and 46, 50. Thus, the web members 20 are restrained from up or down movement within the confines of the keeper 16, but may shift laterally as required to accommodate utensils. Also, a series of utensil-receiving entrance openings 61 are defined between adjacent web members 20, whereas the web sections 52, 54 are separable adjacent the remote ends 58, 60 thereof. The web members 20 are preferably formed of a resilient synthetic resin material such as polystyrene, and when placed as the set 18 confined by the keeper 16, are in resilient contact with each other and exert a resilient compressive retaining force when separated.

Figure 4:
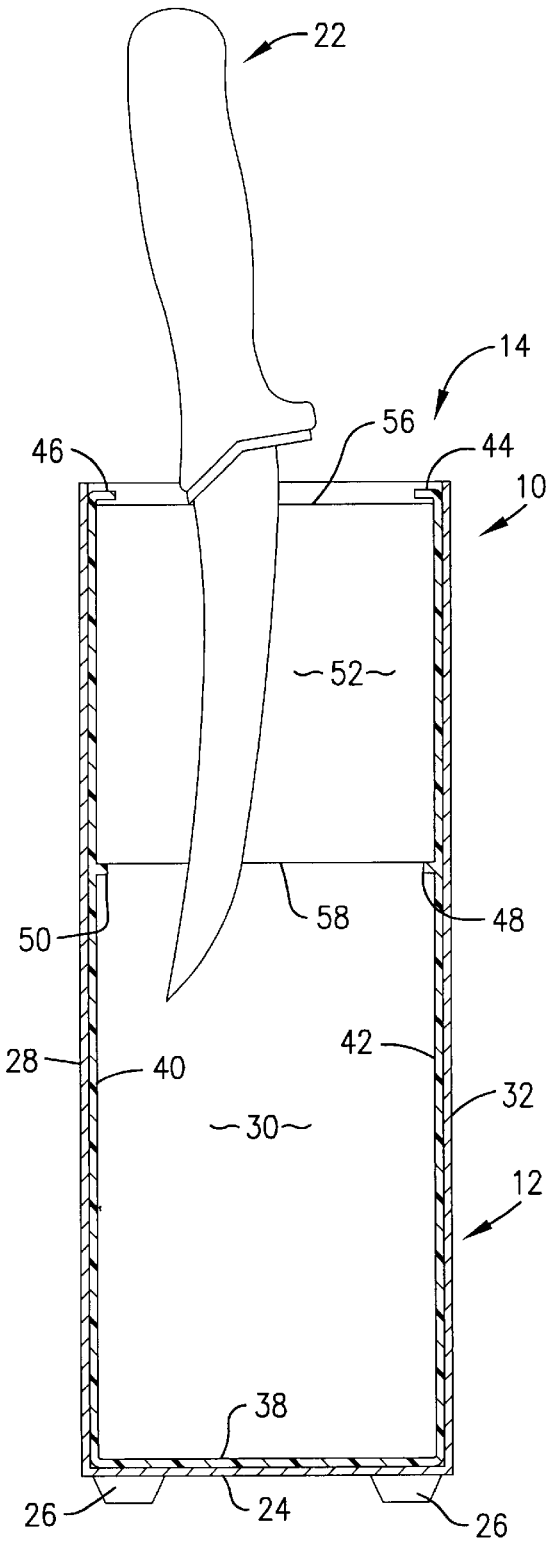
FIG. 4 is a vertical sectional view taken along line 4—4 of FIG. 3 and further illustrating the construction of the knife holder.

In the use of holder 10, the web members 20 are first placed within keeper 16 between the flanges and ledges 44,48 and 46,50 to form the utensil retainer 14. At this point, the entire retainer 14 is slid into housing 12 until the retainer is fully contained therein and assumes the configuration shown in FIGS. 3 and 4. The holder 10 is then ready to accept utensils such as the knives 22. As depicted in FIGS. 3–5, the exemplary knives each include an enlarged handle 62 as well as a blade 64. The knives can thus be inserted blade first into an entrance opening 61 and slid downwardly until the butt end of handle 62 engages the corresponding pair of web member apexes 56; this causes the adjacent web members 20 to be slightly laterally separated to accommodate the blade 64. It will be observed in this respect that, for a typical kitchen knife, the blade 64 extends below the remote margins 58, 60 of the web sections 52, 54, and into the confines of housing 12 below the web member set 18. In the illustrated configuration of the holder 10, sufficient space is provided below the set 18 to accommodate a wide variety of knives or other utensils. The resilient nature of the web members 20 assures that the knives 22 will remain in an essentially upright position while in holder 10. This arises by virtue of the compressive force exerted by the web members 20 against the portions of blade 64 therebetween. At the same time though, the knife 22 can be readily pulled from the holder 10 for use. This is accomplished without inadvertent removal of any of the web members 20, owing to the presence of the flanges 44, 46.

It will be appreciated that the retainer 14, while preferably comprising the individual resilient synthetic resin members 20, could also include differently configured and/or non-resilient web, together with a spring or other biasing means serving to create the desirable compressive forces against a utensil received within the holder 10.

It will be readily appreciated that the design of the holder 10 permits easy cleanup and sterilization. Indeed, the individual components of the holder 10 may be completely disassembled and washed, either manually or in a dishwasher, and these can then be quickly reassembled.

I claim:

1. A utensil holder comprising:

a housing presenting a utensil-receiving opening; and a utensil retainer located within said housing and proximal to said opening, said retainer including a plurality of side-by-side web members each having an entrance end and a remote end, there being a utensil-receiving opening between adjacent ones of said web members for receiving therein utensil portions, said web members configured to exert a compressive retaining force against said utensil portions within said openings, said retainer including a keeper for said web members within said housing, said keeper including a pair of opposed, inwardly extending marginal flanges engaging the entrance ends of said web members in order to retain the web members in place during withdrawal of a utensil from said holder.

2. The holder of claim 1, at least certain of said web members comprising a pair of interconnected web sections.

3. The holder of claim 2, each of said certain web members being integrally formed of resilient synthetic resin material and having a generally V-shape configuration in cross-section with an elongated apex and a pair of diverging web sections, said apex defining the entrance end of said web member.

4. The holder of claim 3, the web sections of adjacent web members being in resilient contact with each other, prior to insertion of a utensil portion therebetween.

5. The holder of claim 1, said housing presenting a base and upright sidewalls, said opening located at the upper end of said housing.

6. The holder of claim 1, said keeper including a pair of opposed, inwardly extending ledges engaging the remote ends of said web members.

7. The holder of claim 1, said housing having a length substantially greater than the length of said web members between said entrance and remote ends thereof.

8. The holder of claim 1, said web members being formed of polystyrene.

9. The holder of claim 1, said remote ends of said web members being separable to permit said utensil portions to pass through said web members and beyond said remote ends thereof.

10. A utensil holder comprising:

a housing presenting a utensil-receiving opening;

a keeper removably disposed within the housing, said keeper having a utensil-receiving opening proximal to the utensil-receiving opening of the housing; and a plurality of guide-by-side web members removably disposed within the keeper, each web member having an entrance end and a remote end, there being a utensil-receiving opening between adjacent ones of said web members for receiving therein utensil portions, said web members configured to exert a compressive retaining force against said utensil portions within said openings, said keeper including a pair of opposed, inwardly extending marginal flanges engaging the entrance ends of said web members and a pair of opposed, inwardly extending ledges engaging the remote end of said web members, said flanges retaining the web members in place during withdrawal of a utensil from said holder, said ledges retaining the web members in place during insertion of a utensil into said holder.

11. The holder of claim 10, said web sections being in resilient contact with each other, prior to insertion of a utensil portion therebetween.

12. The holder of claim 11, said remote ends of said web members being separable to permit said utensil portions to pass through said web members and beyond said remote ends thereof.

13. The holder of claim 10, each of said web members having a generally V-shape configuration in cross-section with an elongated apex and a pair of diverging web sections, said apex defining the entrance end of said web member.

14. The holder of claim 10, said keeper being fully contained within said housing.

15. A utensil holder comprising:

a housing presenting a utensil-receiving opening; and a utensil retainer located within said housing and proximal to said utensil-receiving opening, said retainer including a plurality of side-by-side web members each having an entrance end and a remote end, there being a utensil-insertion opening between adjacent ones of said web members for receiving therein a utensil portion, at least some of said web members each being bent over on itself and yieldably flexed when the utensil portion is inserted within said insertion-opening such that a compressive retaining force is exerted against the utensil portion.

16. The holder as claimed in claim 15, said at least some of said web members being bent at a location proximate the utensil-receiving opening.

17. The holder as claimed in claim 15, said at least some of said web members being generally V-shaped with the sides of each web member connected to one another proximate the utensil-receiving opening.

18. A utensil holder comprising:

a housing presenting a utensil-receiving opening; and a utensil retainer located within said housing and proximal to said utensil-receiving opening, said retainer including a plurality of side-by-side web members each having an entrance end and a remote end, there being a utensil-insertion opening between adjacent ones of said web members for receiving therein a utensil portion, at least some of said web members presenting a bend and a pair of flanges projecting from the bend and arranged to yieldably flex when the utensil portion is inserted within said utensil-insertion opening such that a compressive retaining force is exerted against the utensil portion.

19. The holder as claimed in claim 18, said bend being proximate to the utensil-receiving opening.

20. The holder as claimed in claim 18, said at least some of said web members being generally V-shaped.

* * * * *